US009222051B2

(12) United States Patent
Galic Raguz et al.

(10) Patent No.: US 9,222,051 B2
(45) **Date of Patent: *Dec. 29, 2015**

(54) LUBRICATING COMPOSITION WITH IMPROVED TBN RETENTION

(75) Inventors: Mary Galic Raguz, Mentor, OH (US); Virginia A. Carrick, Chardon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/118,765

(22) PCT Filed: May 30, 2012

(86) PCT No.: PCT/US2012/039965

§ 371 (c)(1), (2), (4) Date: Nov. 19, 2013

(87) PCT Pub. No.: WO2012/166781

PCT Pub. Date: Dec. 6, 2012

(65) Prior Publication Data

US 2014/0187458 A1 Jul. 3, 2014

Related U.S. Application Data

(60) Provisional application No. 61/491,369, filed on May 31, 2011.

(51) Int. Cl.

| | |
|---|---|
| ***C10M 133/08*** | (2006.01) |
| ***C10M 133/12*** | (2006.01) |
| ***C10M 133/16*** | (2006.01) |
| ***C10M 133/38*** | (2006.01) |
| ***C10M 133/42*** | (2006.01) |
| ***C10M 167/00*** | (2006.01) |

(52) U.S. Cl.

CPC ..... *C10M 133/12* (2013.01); *C10M 133/16* (2013.01); *C10M 133/38* (2013.01); *C10M 133/42* (2013.01); *C10M 167/00* (2013.01); *C10M 2207/026* (2013.01); *C10M 2207/028* (2013.01); *C10M 2207/289* (2013.01); *C10M 2215/06* (2013.01); *C10M 2215/064* (2013.01); *C10M 2215/065* (2013.01); *C10M 2215/068* (2013.01); *C10M 2215/08* (2013.01); *C10M 2215/16* (2013.01); *C10M 2215/22* (2013.01); *C10M 2215/221* (2013.01); *C10M 2215/223* (2013.01); *C10M 2215/28* (2013.01); *C10M 2219/046* (2013.01); *C10M 2223/045* (2013.01); *C10N 2230/10* (2013.01); *C10N 2230/45* (2013.01); *C10N 2230/52* (2013.01); *C10N 2240/10* (2013.01)

(58) Field of Classification Search

CPC ..... C10M 2215/064; C10N 2230/52; C10N 2240/12

USPC ..... 508/500, 563

See application file for complete search history.

(56) References Cited

U.S. PATENT DOCUMENTS

| | | | | |
|---|---|---|---|---|
| 2,369,090 | A | 2/1945 | Trautman | |
| 2,390,943 | A | 12/1945 | Kavanaugh et al. | |
| 2,771,368 | A | 11/1956 | Thompson | |
| 3,414,618 | A | 12/1968 | Randell | |
| 3,585,137 | A | 6/1971 | Bosniack et al. | |
| 3,642,632 | A | 2/1972 | Coburn et al. | |
| 3,856,690 | A | 12/1974 | Braid | |
| 4,234,434 | A | 11/1980 | Wulfers | |
| 2005/0230664 | A1 | 10/2005 | Duyck et al. | |
| 2006/0014653 | A1* | 1/2006 | Busse et al. | 508/391 |
| 2009/0131290 | A1 | 5/2009 | Ma et al. | |
| 2009/0131293 | A1 | 5/2009 | Ma et al. | |
| 2010/0099589 | A1 | 4/2010 | Ryan et al. | |
| 2010/0160195 | A1 | 6/2010 | Cheng et al. | |
| 2012/0040876 | A1* | 2/2012 | Preston et al. | 508/500 |

FOREIGN PATENT DOCUMENTS

| | | |
|---|---|---|
| EP | 1801189 | 6/2007 |
| EP | 2055763 | 5/2009 |
| EP | 2206764 | 7/2010 |
| WO | 2009/064604 | 5/2009 |
| WO | 2010/107882 | 9/2010 |

OTHER PUBLICATIONS

Written Opinion of the Corresponding International Application No. PCT/US2012/039965 dated Jul. 27, 2012.

Search Report of the Corresponding International Application No. PCT/US2012/039965 dated Jul. 27, 2012.

Corresponding International Publication No. WO2012/166781 A1 Published Dec. 6, 2012.

* cited by examiner

*Primary Examiner* — Vishal Vasisth

(74) *Attorney, Agent, or Firm* — David M. Shold; Teresan W. Gilbert

(57) ABSTRACT

The invention provides a lubricating composition containing a diarylamine, an aminobenzene and an oil of lubricating viscosity. The invention further relates to the use of the lubricating composition in an internal combustion engine. The invention further relates to the use of the lubricating composition to improve TBN retention.

9 Claims, No Drawings

LUBRICATING COMPOSITION WITH IMPROVED TBN RETENTION

This application is a 371 of PCT/US12/39965, filed May 30, 2012 which claims benefit of 61/491,369, filed May 31, 2011.

FIELD OF INVENTION

The invention relates to compositions containing diarylamines and aminobenzenes and their use in lubricants, such as engine oils. In particular the invention relates to a low ash lubricating composition with an additive composition that provides improved retention of basicity without sacrificing acid control.

BACKGROUND OF THE INVENTION

It is known that lubricants become less effective during their use due to exposure to the operating conditions of the device they are used in, and particularly due to exposure to by-products generated by the operation of the device. For example, engine oil becomes less effective during its use, in part due to exposure of the oil to acidic and pro-oxidant byproducts. These byproducts result from the incomplete combustion of fuel in devices such as internal combustion engines, which utilize the oil. These byproducts lead to deleterious effects in the engine oil, and so, on the engine as well. The byproducts can oxidize hydrocarbons found in the lubricating oil, yielding carboxylic acids and other oxygenates. These oxidized and acidic hydrocarbons can then go on to cause corrosion, wear and deposit problems.

Base-containing additives are added to lubricants in order to neutralize such byproducts, thus reducing the harm they cause to the lubricant, such as an engine oil, and so to the device, such as an engine. Over-based calcium or magnesium carbonate detergents have been used for some time as acid scavengers, neutralizing these byproducts and so protecting both the lubricant and the device. However, over-based phenate and sulfonate detergents carry with them an abundance of metal as measured by sulfated ash (ASTM D 874). New industry upgrades for diesel and passenger car lubricating oils are putting ever decreasing limits on the amount of sulfated ash, and by extension the amount of over-based detergent, permissible in an oil.

There is a need for additives that can extend the operational effectiveness of base-containing additives without the addition of increased sulfated ash. In particular, there is a need for additives that can improve the retention of basicity in a lubricant while continuing to minimize the effects of acid build-up in the lubricant.

U.S. Pat. No. 2,390,943 (Kavanagh et al., Dec. 11, 1945) relates to compositions comprising hydrocarbon oil and a combination of stabilizing ingredients.

U.S. Pat. No. 2,369,090 (Trautman, Feb. 6, 1945) and U.S. Pat. No. 3,856,690 (Milton, Dec. 24, 1974) relate to lubricants which are stabilized against oxidative degradation.

U.S. Pat. No. 3,642,632 (Coburn et al., Feb. 15, 1972) relates to lubricant compositions having improved resistance to deterioration under high performance conditions.

U.S. Pat. No. 2,771,368 (Thompson, Nov. 20, 1956) relates to the use of N-substituted trialkoxy anilines as stabilizers for organic compounds, including fuels, mineral oils, and lubricating oils.

U.S. Pat. No. 4,234,434 (Wulfers, Feb. 14, 1979) relates to the use of dialkylanilines as stabilizers for hydrocracked oil.

WO/PCT application 2010/107882 (Preston et al., Sep. 23, 2010), relates to the use of anthranilic acid derivatives as ash-free amine-derived sources of basicity that do not cause harm to seals.

United States application 2010/0160195 (Cheng et al., Jun. 24, 2010) relates to lubricating compositions comprising derivatives of N,N-dialkylated aniline as ash-free boosters of total base number (TBN).

The use of phenyl-α-naphthylamines (PANA) and derivatives thereof as antioxidants in lubricating compositions is well documented. U.S. Pat. No. 3,414,618 (Randell, Dec. 3, 1968) relates to a process to produce alkylated PANA and its use as an antioxidant in lubricating compositions. Recent publications include European patent application 2055763 (May 6, 2009), which relates to a lubricating composition comprising the combination of alkylated diphenylamine and alkylated PANA, and United States application 2010/0099589 (Ryan et al., Apr. 22, 2010), which relates to a lubricating composition with a combination of alkylated PANA and triazoles for oxidation control.

Diaromatic amine antioxidants with edge-sharing rings have been described previously in United States patent applications 2009/0131293 (Ma et al., May 21, 2009) and 2009/0131290 (Ma et al., May 21, 2009). Application 2009/0131290 relates to dihydroacridan derivatives as ashless antioxidants.

It has now been discovered that lubricating compositions comprising a combination of select diarylamines with aminobenzenes, including anthranilic acid, provide for improved TBN retention. Unexpectedly, this may be accomplished without increasing the deleterious effects of acid build-up in lubricants such as engine oil.

SUMMARY OF THE INVENTION

The present invention provides a lubricating composition containing, i.e., comprising (a) an oil of lubricating viscosity, (b) a diarylamine (which term includes a substituted diarylamine) wherein at least one of the aryl groups comprises 2 or more edge-sharing rings, and (c) an aminobenzene different from (b) said diarylamine. The lubricating composition of the invention provides an ash-free source of TBN that reduces the rate of TBN consumption without causing harm to wear, corrosion, or deposits. The present invention also relates to a method for improving TBN retention in an engine oil lubricant, especially a lubricant with low levels of sulfated ash.

The invention also provides a lubricating composition comprising (a) an oil of lubricating viscosity, (b) a diarylamine of formula (I)

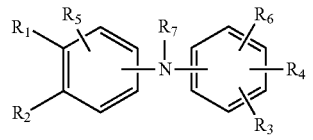

(I)

wherein $R_1$ and $R_2$ are moieties which, together with the carbon atoms to which they are bonded, are joined together to form a 5-, 6-, or 7-membered ring; $R_3$ and $R_4$ are independently hydrogen, hydrocarbyl groups, or are moieties which, taken together with the carbon atoms to which they are bonded, form a 5-, 6-, or 7-membered ring; $R_5$ and $R_6$ are independently hydrogen, hydrocarbyl groups or are moieties which, taken together with the carbon atoms to which they are attached, form a ring, or represent a direct linkage between the rings to which they are attached; and $R_7$ is hydrogen or a hydrocarbyl group;

and (c) an aminobenzene of formula (II)

(II)

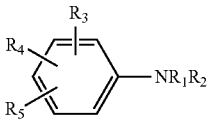

wherein $R_1$ and $R_2$ are independently hydrogen; hydrocarbyl groups; hydrocarbyl groups linked together to form a ring; —$CH_2CH_2CN$; —$(CH_2CHR_7—O—)_yH$ where $R_7$ is hydrogen or a hydrocarbyl group and y=1 to 20; or —$CH_2CH_2C(O)XR_6$, where X is, —O—, —S—, or —$NR_6$—, each $R_6$ is independently a hydrogen or hydrocarbyl group; $R_3$, $R_4$, and $R_5$ are independently hydrogen, hydrocarbyl groups, alkoxy groups, or acyl derivatives (that is, acyl groups) —$C(X_1)A$ wherein $X_1$ is oxygen or sulfur and A is $X_2$—$R_8$ where $X_2$ is oxygen or sulfur and $R_8$ is a hydrocarbyl group.

The invention provides for lubricating compositions containing the additives described above wherein the total sulfated ash is no more than 1.5% by weight of the composition, the phosphorus content is no more than 0.12% by weight of the composition, and/or the sulfur content is no more than 0.4% by weight of the composition.

DETAILED DESCRIPTION OF THE INVENTION

Various preferred features and embodiments will be described below by way of non-limiting illustration.

The present invention provides a lubricating composition comprising (a) an oil of lubricating viscosity, (b) a substituted diarylamine wherein at least one of the aryl groups comprises 2 or more edge-sharing rings, and (c) an aminobenzene compound different from (b).

Oil of Lubricating Viscosity

One component of the disclosed technology is an oil of lubricating viscosity. The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAO) | | | |
| Group V | All others not included in Groups I, II, III, or IV | | | |

In one embodiment, the base oil as used in the present technology has less than 300 ppm sulfur and/or at least 90% saturate content, by ASTM D2007. In certain embodiments, the base oil has a viscosity index of at least 95 or at least 115. In one embodiment, the base oil of the invention has a viscosity index of at least 120, is a polyalphaolefin, or is comprised of mixtures of such materials.

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil, and other vegetable acid esters) as well as mineral lubricating oils such as liquid petroleum oils and solvent-treated or acid treated mineral lubricating oils of the paraffinic, naphthenic, or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof. Alkylene oxide polymers and interpolymers and derivatives thereof, and those where terminal hydroxyl groups have been modified by, for example, esterification or etherification, constitute other classes of known synthetic lubricating oils that can be used. Another suitable class of synthetic lubricating oils that can be used comprises the esters of dicarboxylic acids and those made from C5 to C12 monocarboxylic acids and polyols or polyol ethers.

Other suitable synthetic lubricating oils include liquid esters of phosphorus-containing acids, polymeric tetrahydrofurans, silicon-based oils such as the poly-alkyl-, polyaryl-, polyalkoxy-, or polyaryloxy-siloxane oils, and silicate oils.

Hydrotreated naphthenic oils are also known and can be used. Synthetic oils may be used, such as those produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The amount of oil in a fully formulated lubricant will typically be the amount remaining to equal 100 percent after the remaining additives are accounted for. Typically this may be 60 to 99 percent by weight, or 70 to 97 percent, or 80 to 95 percent, or 85 to 93 percent. The disclosed technology may also be delivered as a concentrate, in which case the amount of oil is typically reduced and the concentrations of the other components are correspondingly increased. In such cases the amount of oil may be 30 to 70 percent by weight or 40 to 60 percent.

Substituted Diarylamine Additive

The lubricating composition of the invention contains a diarylamine wherein at least one of the aryl groups comprises two or more edge-sharing rings. Edge-sharing rings are structures where two or more cyclic groups share two adjoining atoms, such as may be found in phenyl-α-naphthylamine and similar derivatives, all of which are referred to herein as diarylamines. These additives may be used as lubricant additives and include those described by formula (I):

(I)

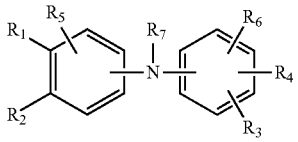

wherein $R_1$ and $R_2$ are moieties which, together with the carbon atoms to which they are bonded, are joined together to form a 5-, 6-, or 7-membered ring (such as a carbocyclic ring or cyclic hydrocarbylene ring); $R_3$ and $R_4$ are independently hydrogen, hydrocarbyl groups, or are moieties which, taken together with the carbon atoms to which they are bonded, form a 5-, 6-, or 7-membered ring (such as a carbocyclic ring or cyclic hydrocarbylene ring); $R_5$ and $R_6$ are independently hydrogen, hydrocarbyl groups, or are moieties (typically hydrocarbyl moieties) which, taken together with the carbon atoms to which they are attached, form a ring, or represent a zero-carbon or direct linkage between the rings; and $R_7$ is hydrogen or a hydrocarbyl group.

The hydrocarbyl groups provided above may each independently contain from 1 to 20 carbon atoms, or from 6 to 12 carbon atoms, or even from 8 to 10 carbon atoms; alternatively, 1 to 6, 1 to 4, 1 to 2, or 1 carbon atom(s).

In one embodiment, the diarylamine is a N-phenyl-naphthylamine (PNA). PNA may be represented by formula (1a):

(Ia)

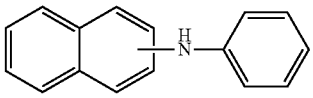

The naphthyl group may be attached in the 1- (or α-) position or the 2- (or β-) position. In one embodiment, the PNA is phenyl-α-naphthylamine (PANA).

In one embodiment, the diarylamine is an alkylated phenyl-α-naphthylamine (APANA). APANA may be represented by formula (1b):

(Ib)

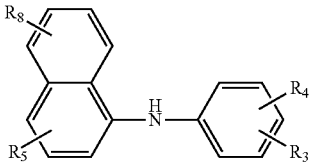

wherein $R_3$ and $R_4$ are independently hydrogen or hydrocarbyl groups of 6 to 16 carbon atoms and at least one of $R_3$ and $R_4$ is not hydrogen; $R_5$ and $R_8$ are independently hydrogen, hydrocarbyl groups of 6 to 16 carbon atoms, or, together with the carbon atoms to which they are bonded, are joined together to form a 5-, 6-, or 7-membered ring. In one embodiment, the APANA of formula (Ib) comprises a mono-alkylated derivative where $R_3$ is a C8 hydrocarbyl group and $R_4$, $R_5$, and $R_8$ are hydrogen.

In another embodiment, the diarylamine may be represented by formula (Ic):

(Ic)

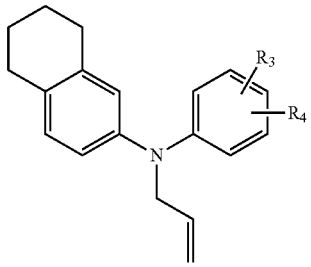

wherein $R_3$ and $R_4$ are defined as above.

In another embodiment, the diarylamine compounds include those having the general formula (Id)

(Id)

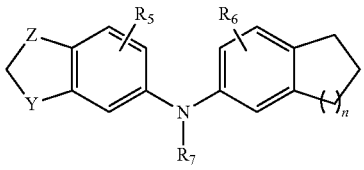

wherein $R_7$ is defined as above; $R_5$ and $R_6$ are independently hydrogen, hydrocarbyl groups or taken together may form a ring, such as a dihydroacridan; n=1 or 2; and Y and Z independently represent carbon or heteroatoms such as N, O and S.

In a particular embodiment, compounds of formula (Id) further comprise an N-allyl group, for example the compound of formula (Ie)

(Ie)

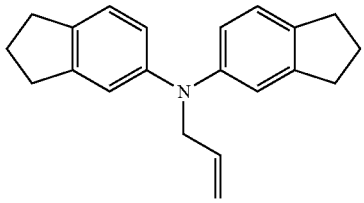

In one embodiment, the diarylamine is a dihydroacridan derivative of formula (If)

(If)

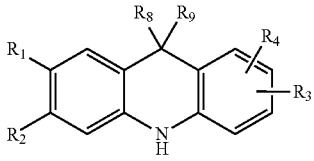

wherein $R_1$, $R_2$, $R_3$, and $R_4$ are defined above; $R_8$ and $R_9$ are independently hydrogen or a hydrocarbyl group of 1 to 20 carbon atoms.

In one embodiment, the diarylamine of formula (1) is chosen such that $R_5$ and $R_6$ represent a direct (or zero-carbon) link between the aryl rings. The result is a carbazole of formula (Ig)

(Ig)

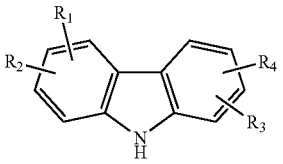

wherein $R_1$, $R_2$, $R_3$, and $R_4$ are defined as above.

The diarylamine additive of the invention may be present on a weight basis of this invention at 0.1% to 10%, 0.35% to 5%, or even 0.5% to 2%.

The Aminobenzene Compound

The lubricating composition of the invention contains an aminobenzene compound different from the aforementioned diarylamine compound (b), such as N,N-dialkylaniline or anthranilate esters and similar additives, all of which are referred to herein as aminobenzene compounds. An aminobenzene different from (b) will typically mean an aminobenzene compound that does not fit within the definition of the substituted diarylamine compound of (b) as defined and described hereinabove. The term "aminobenzene" is intended to encompass substituted aminobenzenes including those with substituents on the benzene ring. These additives may be used as lubricant additives and include those described by formula (II)

(II)

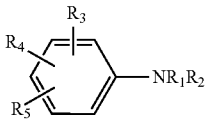

wherein $R_1$ and $R_2$ are independently hydrogen; hydrocarbyl groups; hydrocarbyl groups linked together to form a ring; —$CH_2CH_2CN$; —$(CH_2CHR_7—O—)_yH$ where $R_7$ is hydrogen or a hydrocarbyl group and y=1 to 20; or —$CH_2CH_2C(O)XR_6$, (or alternatively —$CH_2CHR_7C(O)XR_6$ where $R_7$ is a hydrocarbyl group) where X is, —O—, —S—, or —$NR_6$—, $R_6$ is a hydrogen or hydrocarbyl group; $R_3$, $R_4$, and $R_5$ are independently hydrogen, hydrocarbyl groups, alkoxy groups, or acyl derivatives —$C(X_1)A$ wherein $X_1$ is oxygen or sulfur; and A is $X_2$—$R_8$ where $X_2$ is oxygen or sulfur and $R_8$ is a hydrocarbyl group. The hydrocarbyl groups provided in this description may each independently contain from 1 to 20 carbon atoms, or from 6 to 12 carbon atoms, or even from 8 to 10 carbon atoms; alternatively, 1 to 6, 1 to 4, 1 to 2, or 1 carbon atom(s).

In one embodiment, the aminobenzene compound is a monoarylamine. The aminobenzene of formula (II) may be selected such that $R_1$ and $R_2$ are independently hydrogen or hydrocarbyl groups wherein neither $R_1$ nor $R_2$ comprise an aryl ring directly attached to the aminobenzene nitrogen atom.

The hydrocarbyl groups provided above may each independently contain from 1 to 20 carbon atoms or from 1, 2, 4, 5 or 6 carbon atoms up to 20, 18, 16, 12, 10 or 8 carbon atoms.

In one embodiment, the aminobenzene compound may be an anthranilic acid derivative described by formula (IIa):

(IIa)

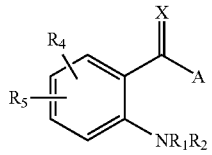

wherein X is oxygen or sulfur and A is $X_2$—$R_8$ where $X_2$ is oxygen or sulfur and $R_8$ is a hydrocarbyl group; $R_1$ and $R_2$ are independently hydrogen; hydrocarbyl groups; hydrocarbyl groups linked together to form a ring; —$CH_2CH_2CN$; or —$CH_2CH_2C(O)XR_6$, where X is —O—, —S—, or —$NR_6$—, $R_6$ is hydrogen, or a hydrocarbyl group or —$(CH_2CHR_7—O—)_yH$ where $R_7$ is hydrogen or a hydrocarbyl group and y=1 to 20; and $R_4$, and $R_5$ are independently hydrogen, hydrocarbyl groups or taken together form a ring.

In some embodiments the anthranilic acid derivatives of the present invention are derived from a 4-(dialkylamino) benzoic acid and/or a 4-(alkylamino)benzoic acid by reacting the acid with an alcohol, optionally in the presence of a catalyst. Examples of suitable acids include but are not limited to 4-(dimethylamino)benzoic acid, 4-(diethylamino)benzoic acid, 4-(dipropylamino)-benzoic acid, 4-(methylamino) benzoic acid, 4-(ethylamino)benzoic acid, 4-(propyl-amino) benzoic acid, or any combination thereof. In other embodiments the additives of the present invention are derived from a 3-(dialkylamino)benzoic acid and/or a 3-(alkylamino)benzoic acid by reacting the acid with an alcohol, optionally in the presence of a catalyst. Examples of suitable acids include but are not limited to 3-(dimethylamino)benzoic acid, 3-(diethylamino)benzoic acid, 3-(dipropylamino)-benzoic acid, 3-(methylamino)benzoic acid, 3-(ethylamino)benzoic acid, 3-(propyl-amino)benzoic acid, or any combination thereof.

In one embodiment, the aminobenzene compound is an anthranilic acid derivative of formula (IIb):

(IIb)

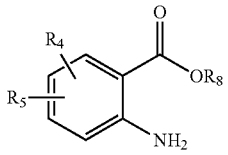

wherein $R_4$, and $R_5$ are independently hydrogen, hydrocarbyl groups, or, taken together with the carbon atoms to which they are bonded, form a 5-, 6-, or 7-membered ring; $R_8$ is a hydrocarbyl group.

In any of the embodiments described above $R_8$ may be: (i) a hydrocarbyl group containing at least 8 carbon atoms; (ii) a hydrocarbyl group containing at least one branch point; (iii) a fully saturated alkyl group; or (iv) any combination of one or more embodiments thereof.

In other embodiments, the anthranilate ester may be described as the reaction product of an alcohol and a hetero bicyclic aromatic compound consisting of a nitrogen-containing ring and an aromatic ring, where the nitrogen-containing ring has groups at the 2 and 4 positions, and where the ring also contains an additional oxygen atom, typically in between the groups. The aromatic ring may have up to four substituent groups attached to the carbon atoms in the ring. These substituent groups may be hydrocarbyl groups. In one embodiment there are no substituent groups on the aromatic ring. A suitable hetero bicyclic aromatic compound is isatoic anhydride. In some embodiments the anthranilate ester additive of the present invention, as described by any of the formulas above, is derived or derivable from isatoic anhydride.

The reaction of the alcohol and the hetero bicyclic aromatic compound may be carried out in the presence of a basic catalyst, such as NaOH.

Suitable alcohols may be described by the formula $R_8$—OH where $R_8$ is a hydrocarbyl group as defined above. In some embodiments the alcohol and/or the $R_8$ group in the alcohol is chosen to impart oil solubility to the ester product.

In some embodiments the alcohol used to prepare the anthranilic acid derivative is a mixture of linear alcohols where the alcohols may contain 1 to 4, 2 to 10, 3 to 6, or 8 to 10 carbon atoms. In some embodiments the alcohol used to prepare the additive is: decyl alcohol; tridecyl alcohol, optionally with one or more branch points such as isotridecyl alcohol and 2,4,6,8-tetramethyl-nonanol; 2-ethylhexanol; or combinations thereof. In other embodiments, the alcohol used may contain 1-24, 2 to 18, 4 to 14 or 6 to 12 carbon atoms and any of the alcohols listed herein may be used in combination with one another.

In some embodiments the alcohol used to prepare the anthranilic acid derivative is: 2,4,6,8-tetramethyl-nonanol, a mixture of linear alcohols where the alcohols may contain 8 to 10 carbon atoms, 2-ethylhexanol, or combinations thereof. In still other embodiments, the alcohol used is 2,4,6,8-tetramethyl-nonanol, a mixture of linear alcohols where the alcohols may contain 8 to 10 carbon atoms, or combinations thereof. In still other embodiments, the anthranilic acid derivative is derived from 2,4,6,8-tetramethyl-nonanol.

In some embodiments the anthranilic acid derivative is derived from isatoic anhydride and an alcohol component consisting of 2,4,6,8-tetramethyl-nonanol, a mixture of linear alcohols where the alcohols may contain 8 to 10 carbon atoms, 2-ethylhexanol, or combinations thereof. In still other embodiments the additive is derived from isatoic anhydride and 2,4,6,8-tetramethyl-nonanol and/or a mixture of linear alcohols where the alcohols may contain 8 to 10 carbon atoms.

In one embodiment the aminobenzene compound may be a compound of formula (II), wherein $R_1$ and $R_2$ are independently hydrogen; hydrocarbyl groups; hydrocarbyl groups linked together to form a ring; —$CH_2CH_2CN$; or —$CH_2CH_2C(O)XR_6$, where X is —O—, —S—, or —$NR_6$—, $R_6$ is a hydrogen or hydrocarbyl group; $R_3$, $R_4$, and $R_5$ are independently hydrogen, hydrocarbyl groups, or alkoxy groups, with the proviso that at least one of $R_1$, $R_2$, $R_3$, $R_4$, and $R_5$ is not hydrogen.

In one embodiment the aminobenzene compound is aniline or an N,N-dialkyl aniline (i.e. $R_1$ and $R_2$ are independently hydrocarbyl groups). The N-hydrocarbyl groups may each independently contain from 1 to 20 carbon atoms or from 1, 2, 4, 5 or 6 carbon atoms up to 20, 18, 16, 12, 10 or 8 carbon atoms. In a further embodiment, the N,N-dialkylaniline is substituted with an alkoxy group (i.e. one of $R_3$, $R_4$ or $R_5$ is an alkoxy group), preferably in a position para to the amino group.

Aniline is commercially available. N,N-dialkylaniline can be prepared by reacting aniline and alkylhalide (e.g., alkylbromide) in a 2:1 molar ratio, in the presence triethylamine, in an acetonitrile solvent. The attachment of a hydrocarbyl group R' or alkoxy group to the aniline or N,N-dialkylene moiety can be accomplished using a number of well known techniques, such as a Friedel-Crafts reaction in which an olefin, halogenated olefin or hydrohalogenated analog thereof is reacted with the aniline or N,N-dialkylaniline in the presence of a Lewis acid catalyst (e.g., boron trifluoride and complexes of boron trifluoride with ethers, phenols, hydrogen fluoride; aluminum chloride, aluminum bromide, zinc dichloride). Those skilled in the art will be aware of numerous, equally well known methods for alkylated aniline. Methods for providing aniline with an alkoxy substituent are also well known and a number of such methods are described, for example, in U.S. Pat. No. 5,493,055.

In some embodiments the substituted aniline may be selected from N,N-dihexylaniline, para-ethoxy-N,N-dihexylaniline, ortho-methoxy-N,N-dihexylaniline, N,N-dimethylaniline, N,N-diethylaniline, N,N-dipropylaniline, N,N-dibutylaniline.

The aminobenzene compound may be present in the lubricating compositions in amounts that deliver specific amounts of TBN, as described below. In other embodiments, used in combination with any of the embodiments described above, the additive may be present in a lubricating composition at 0.5, 1.0, 1.2 or 2.0 percent by weight or more. In still other embodiments, the additive is present within a range having a lower limit of 0.5, 1.0, 1.2 or 2.0 percent by weight and an upper limit of 3.0, 4.0, 4.5 or 5.0 percent by weight.

Other Performance Additives

In some embodiments, the compositions of the present invention contain one or more additional additives. A suitable additional additive is a detergent, where the detergent is different from the aniline derivative described above.

Most conventional detergents used in the field of engine lubrication, unlike those of the present technology, obtain most or all of their basicity or TBN from the presence of basic metal-containing compounds (metal hydroxides, oxides, or carbonates, typically based on such metals as calcium, magnesium, zinc, or sodium). Such metallic overbased detergents, also referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are typically prepared by reacting an acidic material (typically an inorganic acid or lower carboxylic acid such as carbon dioxide) with a mixture of an acidic organic compound (also referred to as a substrate), a stoichiometric excess of a metal base, typically in a reaction medium of an one inert, organic solvent (e.g., mineral oil, naphtha, toluene, xylene) for the acidic organic substrate. Typically also a small amount of promoter such as a phenol or alcohol is present, and in some cases a small amount of water. The acidic organic substrate will normally have a sufficient number of carbon atoms to provide a degree of solubility in oil.

Such conventional overbased materials and their methods of preparation are well known to those skilled in the art. Patents describing techniques for making basic metallic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Salixarate detergents are described in U.S. Pat. No. 6,200,936.

The overbased metal-containing detergent may be selected from the group consisting of non-sulfur containing phenates, sulfur containing phenates, sulfonates, salixarates, salicylates, and mixtures thereof, or borated equivalents thereof. The overbased detergent may be borated with a borating agent such as boric acid.

In one embodiment the overbased metal-containing detergent may be zinc, sodium, calcium or magnesium salts of a phenate, sulfur containing phenate, sulfonate, salixarate or salicylate. Overbased salixarates, phenates and salicylates typically have a total base number (ASTM D3896) of 180 to 450 TBN. Overbased sulfonates typically have a total base number of 250 to 600, or 300 to 500. Overbased detergents are known in the art. In one embodiment the sulfonate detergent may be a predominantly linear alkylbenzene sulfonate detergent having a metal ratio of at least 8 as is described in paragraphs [0026] to [0037] of US Patent Application 2005-065045. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The predominantly linear alkylbenzene sulfonate detergent may be particularly useful for assisting in improving fuel economy. In some embodiments the linear alkyl group may be attached to the benzene ring anywhere along the linear chain of the alkyl group, but often in the 2, 3 or 4 position of the linear chain, and in some instances predominantly in the 2 position.

In one embodiment the overbased metal-containing detergent is calcium or magnesium overbased detergent. In one embodiment, the lubricating composition comprises an overbased calcium sulfonate, an overbased calcium phenate, or mixtures thereof. The overbased detergent may comprise calcium sulfonate with a metal ratio of at least 3.

The overbased detergent of the invention may be present in an amount from 0.05% by weight to 5% by weight of the composition. In other embodiments the overbased detergent may be present from 0.1%, 0.3%, or 0.5% up to 3.2%, 1.7%, or 0.9% by weight of the lubricating composition. Similarly, the overbased detergent may be present in an amount suitable to provide from 1 TBN to 10 TBN to the lubricating composition. In other embodiments the overbased detergent is present in amount which provides from 1.5 TBN or 2 TBN up to 3 TBN, 5 TBN, or 7 TBN to the lubricating composition.

The lubricating composition of the invention optionally comprises other performance additives. The other performance additives include at least one of metal deactivators, viscosity modifiers, friction modifiers, antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

Another additive is a dispersant. Dispersants are well known in the field of lubricants and include primarily what is known as ashless-type dispersants and polymeric dispersants. Ashless type dispersants are characterized by a polar group attached to a relatively high molecular weight hydrocarbon chain. Typical ashless dispersants include nitrogen-containing dispersants such as N-substituted long chain alkenyl succinimides, also known as succinimide dispersants. Succinimide dispersants are more fully described in U.S. Pat. Nos. 4,234,435 and 3,172,892. Another class of ashless dispersant is high molecular weight esters, prepared by reaction of a hydrocarbyl acylating agent and a polyhydric aliphatic alcohol such as glycerol, pentaerythritol, or sorbitol. Such materials are described in more detail in U.S. Pat. No. 3,381,022. Another class of ashless dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Other dispersants include polymeric dispersant additives, which are generally hydrocarbon-based polymers which contain polar functionality to impart dispersancy characteristics to the polymer. Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403. The amount of dispersant in the present composition can typically be 1 to 10 weight percent, or 1.5 to 9.0 percent, or 2.0 to 8.0 percent, all expressed on an oil-free basis.

Another component is an antioxidant. Antioxidants encompass phenolic antioxidants, which may comprise a butyl substituted phenol containing 2 or 3 t-butyl groups. The para position may also be occupied by a hydrocarbyl group or a group bridging two aromatic rings. The latter antioxidants are described in greater detail in U.S. Pat. No. 6,559,105. Antioxidants also include aromatic amines, such as nonylated diphenylamine. Other antioxidants include sulfurized olefins, titanium compounds, and molybdenum compounds. U.S. Pat. No. 4,285,822, for instance, discloses lubricating oil compositions containing a molybdenum and sulfur containing composition. Typical amounts of antioxidants will, of course, depend on the specific antioxidant and its individual effectiveness, but illustrative total amounts can be 0.01 to 5, or 0.15 to 4.5, or 0.2 to 4 percent by weight. Additionally, more than one antioxidant may be present, and certain combinations of these can be synergistic in their combined overall effect.

Viscosity improvers (also sometimes referred to as viscosity index improvers or viscosity modifiers) may be included in the compositions of this invention. Viscosity improvers are usually polymers, including polyisobutenes, poly(meth)acrylates (PMA) and poly(meth)acrylic acid esters, hydrogenated diene polymers, polyalkylstyrenes, esterified styrene-maleic anhydride copolymers, hydrogenated alkenylarene-conjugated diene copolymers and polyolefins. PMA's are prepared from mixtures of methacrylate monomers having different alkyl groups. The alkyl groups may be either straight chain or branched chain groups containing from 1 to 18 carbon atoms. Most PMA's are viscosity modifiers as well as pour point depressants.

Multifunctional viscosity improvers, which also have dispersant and/or antioxidancy properties, are known and may optionally be used. Dispersant viscosity modifiers (DVM) are one example of such multifunctional additives. DVM are typically prepared by copolymerizing a small amount of a nitrogen-containing monomer with alkyl methacrylates, resulting in an additive with some combination of dispersancy, viscosity modification, pour point depressancy and dispersancy. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers.

The dispersant viscosity modifier may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph and preparative examples described in paragraphs [0065] to [0073]).

In one embodiment the lubricating composition of the invention further comprises a dispersant viscosity modifier. The dispersant viscosity modifier may be present at 0 wt % to 15 wt %, or 0 wt % to 10 wt %, or 0.05 wt % to 5 wt %, or 0.2 wt % to 2 wt % of the lubricating composition.

In certain embodiments, the dispersant or dispersant viscosity modifier comprises a polymer functionalized with a certain type of amine. The amine used for the polymeric dispersant may be an amine having at least 2 or at least 3 or at least 4 aromatic groups, for instance, 4 to 10 or 4 to 8 or 4 to 6 aromatic groups, and at least one primary or secondary amino group or, alternatively, at least one secondary amino group. In some embodiments the amine comprises both a primary and at least one secondary amino group. In certain embodiments, the amine comprises at least 4 aromatic groups and at least 2 secondary or tertiary amino groups.

Another additive is an antiwear agent. Examples of antiwear agents include phosphorus-containing antiwear/extreme pressure agents such as metal thiophosphates, phosphoric acid esters and salts thereof, phosphorus-containing carboxylic acids, esters, ethers, and amides; and phosphites. In certain embodiments a phosphorus antiwear agent may be present in an amount to deliver 0.01 to 0.2 or 0.015 to 0.15 or 0.02 to 0.1 or 0.025 to 0.08 percent by weight phosphorus. Often the antiwear agent is a zinc dialkyldithiophosphate (ZDP). For a typical ZDP, which may contain 11 percent P (calculated on an oil free basis), suitable amounts may include 0.09 to 0.82 percent by weight. Non-phosphorus-containing anti-wear agents include borate esters (including borated epoxides), dithiocarbamate compounds, molybdenum-containing compounds, and sulfurized olefins.

Other additives that may optionally be used in lubricating oils include pour point depressing agents, extreme pressure agents, color stabilizers and anti-foam agents. One or metal-containing detergents, as described above, may also be included.

The foregoing lubricating oil additives may be added directly to the base oil to form the lubricating oil composition. In one embodiment, however, one or more of the additives may be diluted with a substantially inert, normally liquid organic diluent such as mineral oil, synthetic oil, naphtha, alkylated (e.g., $C_{10}$-$C_{13}$ alkyl)benzene, alkylated toluene or alkylated xylene to form an additive concentrate. These concentrates may contain from about 1 to about 99 percent by weight, and in one embodiment from about 10 to 90 percent by weight of such diluent. The concentrates may be added to the base oil to form the lubricating oil composition.

In some embodiments the lubricating compositions of the present invention comprise at least one additive selected from the group consisting of non-phosphorus-containing anti-wear agents, ashless dispersants, antioxidants, friction modifiers, zinc dithiophosphates, and corrosion inhibitors.

The lubricating compositions of the present invention may have an overall TBN of greater than 6, for example, a TBN of at least 7, 8, 9, 10 or greater. In still other embodiments the lubricating compositions of the present invention also have a sulfated ash content of less than 1.5, 1.3, or 1.0 percent by weight.

The lubricating compositions of the present invention may have a nitrogen content of less than 0.4 or 0.3 percent by weight and/or a soap content of less than 5 or 3 percent by weight.

The lubricant described herein may be used to lubricate a mechanical device, by supplying the lubricant to the device, and in particular to the moving parts. The device may be an internal combustion engine (ICE), a driveline component (e.g., automatic or manual transmission, gear box, differential). The ICE that may be lubricated may include gasoline fueled engines, spark ignited engines, diesel engines, compression-ignited engines, two-stroke cycle engines, four-stroke cycle engines, sump-lubricated engines, fuel-lubricated engines, natural gas-fueled engines, marine diesel engines, and stationary engines. Vehicles in which such ICE may be employed include automobiles, trucks, off-road vehicles, marine vehicles, motorcycles, all-terrain vehicles, and snowmobiles. In one embodiment, the ICE is a heavy duty diesel engine, which may include sump-lubricated, two- or four-stroke cycle engines, which are known to those skilled in the art.

The lubricant composition for an internal combustion engine may be suitable for any engine lubricant irrespective of the sulfur, phosphorus or sulfated ash content. The sulfur content of the engine oil lubricant may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or 0.06 wt % or less, 0.055 wt % or less, or 0.05 wt % or less. In one embodiment the phosphorus content may be 0.4 wt % to 0.12 wt %. In one embodiment the phosphorus content may be 100 ppm to 1000 ppm, or 200 ppm to 600 ppm. The total sulfated ash content may be 0.3 wt % to 1.2 wt %, or 0.5 wt % to 1.1 wt % of the lubricating composition. In one embodiment the sulfated ash content may be 0.5 wt % to 1.1 wt % of the lubricating composition.

Specific Embodiment

The invention will be further illustrated by the following examples, which sets forth particularly advantageous embodiments. While the examples are provided to illustrate the invention, they are not intended to limit it.

Example AB-1: Synthesis of 2-Amino-benzoic acid decyl ester. A one liter, four necked, round bottom flask, equipped with an overhead stirrer, sub-surface gas inlet tube, thermowell, Dean-Stark trap, and Friedrichs condenser, is charged with 937.5 grams (5.92 moles) of decyl alcohol and 7.11 grams (0.18 moles or 180 mmoles) of solid crushed/powdered sodium hydroxide. The flask is purged with nitrogen and warmed to 65° C. 1014.02 grams of isatoic anhydride (6.22 moles) is added portion-wise, supra-surface, over a period of 1 hour 30 minutes. The mixture is stirred at 65° C. for 3 hours, heated to 95° C. over 1 hour and held at 95° C. for 4 hours. 30 grams of filter aid is added to the flask at 105° C. and stirred for 15 minutes. The mixture is filtered and cooled to yield 1629.1 grams of the product, in the form of a brown liquid. The product has a TBN, by ASTM D2896, of 172.3.

Example AB-2: Synthesis of 4-(dimethylamino)benzoic acid decyl ester. A one-liter, four-necked, round-bottom flask, equipped with an overhead stirrer, sub-surface gas inlet tube, thermowell, Dean-Stark trap, and Friedrichs condenser, is charged with 316.3 grams (2.00 moles) of 1-decanol and 30 grams of solid Amberlyst-15 catalyst. The flask is purged with nitrogen and warmed to 120° C. before 165 grams (1.00 mole) of 4-(dimethylamino)benzoic acid is added portion-wise over 10 minutes. Evolved water is condensed in the Dean-Stark trap. The mixture is stirred at 150° C. for 6 hours and filtered hot using 50 grams of filter-aid to remove any particulates. The filtrate is reheated to 150° C. for 1 hr at reduced pressure (<5.3 kPa) (40 mmHg) to remove excess alcohol. The mixture is cooled to yield the desired product, in the form of a brown liquid.

Example AB-3: 4-ethoxy-N,N-dihexylaniline, the synthesis of which is described in, e.g., United States application 2010/0160195, Synthesis Example 1, page 7.

(AN-3)

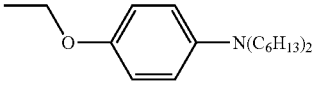

Example ADA-1: p-tert-octylphenyl-α-naphthylamine (APANA) is available from e.g. Ciba Specialty Chemicals (under the trade designation "Irganox L06").

Example ADA-2: 12-octyl-1,2,3,6,9,10,11,12-octahydrodicyclopenta[a,j]acridine according to formula (Ig), the synthesis of which is described in e.g. United States application 2009/0131290, Example 1, page 10.

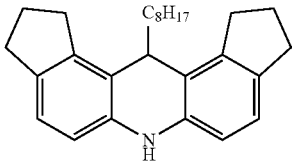

Lubricating Compositions

A series of 15W-40 diesel engine lubricants in base oil of lubricating viscosity are prepared containing the additive composition of the present invention as well as conventional additives including polymeric viscosity modifier, ashless succinimide dispersant, overbased detergents, antioxidants (combination of phenolic ester and diarylamine), zinc dialkyldithiophosphate (ZDDP), as well as other performance additives as follows. Amounts shown are weight percent.

TABLE 1

Lubricating Oil Composition Formulations

| | Comp Ex 1 | Comp Ex 2 | Comp Ex 3 | Ex 1 | Ex 2 | Ex 3 | Ex 4 |
|---|---|---|---|---|---|---|---|
| Base Oil | | | Balance to = 100% | | | | |
| ADA-1 | 0 | 0 | 1.2 | 1.2 | 1.2 | 1.2 | 0 |
| ADA-2 | 0 | 0 | 0 | 0 | 0 | 0 | 1.2 |
| AB-1 | 0 | 1.07 | 0 | 1.07 | 0 | 0 | 1.07 |
| AB-2 | 0 | 0 | 0 | 0 | 1.1 | 0 | 0 |
| AB-3 | 0 | 0 | 0 | 0 | 0 | 1.0 | 0 |
| OCP VM[1] | 6 | 6 | 6 | 6 | 6 | 6 | 6 |
| Additional Additives[2] | 16.6 | 16.6 | 16.6 | 16.6 | 16.6 | 16.6 | 16.6 |
| TBN (D2896) | 9.5 | 11.2 | 9.2 | 11.5 | 9.2 | 11.0 | 11.3 |
| Ash (D874) | 0.96 | 0.96 | 0.99 | 0.97 | 0.96 | 0.97 | 0.97 |

[1]including 90% Oil

[2]Conventional additives include polyalkylene succinimide dispersant (4.4 wt %), overbased calcium sulfonate detergent (1.05 wt %), overbased calcium phenate (0.5 wt %), overbased magnesium detergent (0.65 wt %), zinc dialkyldithiophosphate (0.86 wt %), ashless antioxidant (1.4 wt %), as well as friction modifier and anti-foam agent, each of which may contain a conventional amount of diluent (not separately accounted for).

TBN Retention and Oxidation Testing

The lubricating oil compositions summarized in Table 1 are tested for TBN retention performance using a modified nitration/oxidation bench test. This test involves the addition of nitric acid and NOx to degrade a fully formulated lubricating oil and is modified to measure TBN at the start and end of test. A sample of 40 g of test oil is stressed with nitric acid and Fe(III) oxidation catalyst. The sample is then heated to 145° C. and bubbled with a mixture of air and NOx for 22 hours. TBN as measured by ASTM D2896 is measured at the start of test and at end of test.

The lubricating compositions are also subjected to the ACEA E5 oxidation bench test (CECL85) which determined oxidative stability of a sample by pressure differential scanning calorimetry. Results are reported as the time (in minutes) until the oil breaks and takes up oxidation.

TABLE 2

TBN Retention and Oxidation Test Results

| | Diaryl amine | Amino-benzene Compound | Start of Test D2896 | End of Test D2896 | Oxidation Onset Time (min) |
|---|---|---|---|---|---|
| Comp Ex 1 | — | — | 9.3 | 4.1 | 120 |
| Comp Ex 2 | — | 1.07% AB-1 | 11.3 | 4.3 | 125 |
| Comp Ex 3 | 1.2% ADA-1 | — | 9.4 | 4.8 | 202 |
| Ex 1 | 1.2% ADA-1 | 1.07% AB-1 | 11.1 | 5.5 | 219 |

The results show that addition of the aminobenzene compound imparts additional TBN to the lubricating oil, much of which may be lost as a result of oxidation of the oil. Addition of diarylamine does not increase initial TBN nor does it improve end of test TBN in the absence of the aminobenzene compound. The combination of ADA-1 and AB-1 results in higher initial TBN as well as higher end-of-test TBN.

Similarly, the combination of diarylamine and aminobenzene compound results in an unexpected synergistic boost in oxidative stability. When used alone, the aniline derivative provides little (or no) boost in oxidative stability. However when added to a formulation containing APANA, there is an increase in oxidation onset time of more than 8%.

In this specification the terms "hydrocarbyl substituent" or "hydrocarbyl group," as used herein are used in its ordinary sense, which is well-known to those skilled in the art. Specifically, it refers to a group primarily composed of carbon and hydrogen atoms and is attached to the remainder of the molecule through a carbon atom and does not exclude the presence of other atoms or groups in a proportion insufficient to detract from the molecule having a predominantly hydrocarbon character. In general, no more than two, preferably no more than one, non-hydrocarbon substituent will be present for every ten carbon atoms in the hydrocarbyl group; typically, there will be no non-hydrocarbon substituents in the hydrocarbyl group. A more detailed definition of the terms "hydrocarbyl substituent" or "hydrocarbyl group," is described in U.S. Pat. No. 6,583,092.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, all percent values listed herein are on a weight basis. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricating composition comprising (a) an oil of lubricating viscosity, (b) about 0.1 to about 2 percent by weight of a diarylamine wherein at least one of the aryl groups comprises two or more edge-sharing rings, which comprises an alkylated N-phenyl-α-naphthylamine, (c) about 0.5 to about 4 percent by weight of an anthranilate ester different from (b), being a compound of formula (IIa)

(IIa)

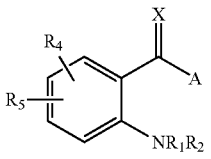

wherein X is oxygen or sulfur and A is $X_2$—$R_8$ where $X_2$ is oxygen or sulfur and $R_8$ is a hydrocarbyl group; $R_1$ and $R_2$ are independently hydrogen; hydrocarbyl groups; hydrocarbyl groups linked together to form a ring; —$CH_2CH_2CN$; or —$CH_2CH_2C(O)XR_6$, where X is —O—, —S—, or —$NR_6$—, $R_6$ is hydrogen, or a hydrocarbyl group or —$(CH_2CHR_7$—O—$)_yH$ where $R_7$ is hydrogen or a hydrocarbyl group and y=1 to 20; and $R_4$, and $R_5$ are independently hydrogen, hydrocarbyl groups or taken together form a ring, and (d) an overbased detergent in an amount that delivers at least 2 TBN to the lubricating composition.

2. The composition of claim 1 wherein (c), the anthranilate ester, is a C6 to C16 ester of anthranilic acid.

3. The composition of claim 1 having a sulfated ash level of up to 1.2 wt %.

4. The composition of claim 1 further comprising at least one additional additive selected from ashless dispersants, anti-wear agents, friction modifiers, antioxidants and viscosity modifiers.

5. A method for lubricating a mechanical device, comprising supplying thereto the composition of claim 1.

6. The method of claim 5 wherein the mechanical device is an internal combustion engine.

7. A method of improving the oxidative stability of a lubricating composition which contains an oil of lubricating viscosity, comprising including within said lubricating composition a combination of (b) about 0.1 to about 2 percent by weight of a diarylamine wherein at least one of the aryl groups comprises 2 or more edge-sharing rings, which comprises an alkylated N-phenyl-α-naphthylamine, (c) about 0.5 to about 4 percent by weight of an anthranilate ester different from (b), being a compound of formula (IIa)

(IIa)

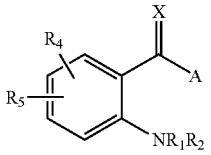

wherein X is oxygen or sulfur and A is $X_2$—$R_8$ where $X_2$ is oxygen or sulfur and $R_8$ is a hydrocarbyl group; $R_1$ and $R_2$ are independently hydrogen; hydrocarbyl groups; hydrocarbyl groups linked together to form a ring; —$CH_2CH_2CN$; or —$CH_2CH_2C(O)XR_6$, where X is —O—, —S—, or —$NR_6$—, $R_6$ is hydrogen, or a hydrocarbyl group or —$(CH_2CHR_7$—O—$)_yH$ where $R_7$ is hydrogen or a hydrocarbyl group and y=1 to 20; and $R_4$, and $R_5$ are independently hydrogen, hydrocarbyl groups or taken together form a ring, and (d) an overbased detergent in an amount that delivers at least 2 TBN to the lubricating composition.

8. A method of improving TBN retention of a lubricating composition which contains an oil of lubricating viscosity, comprising including within said lubricating composition a combination of (b) about 0.1 to about 2 percent by weight of a diarylamine wherein at least one of the aryl groups comprises 2 or more edge-sharing rings, which comprises an alkylated N-phenyl-α-naphthylamine, (c) about 0.5 to about 4 percent by weight of an anthranilate ester different from (b), being a compound of formula (IIa)

(IIa)

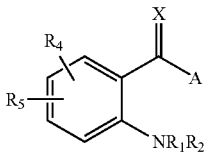

wherein X is oxygen or sulfur and A is $X_2$—$R_8$ where $X_2$ is oxygen or sulfur and $R_8$ is a hydrocarbyl group; $R_1$ and $R_2$ are independently hydrogen; hydrocarbyl groups; hydrocarbyl groups linked together to form a ring; —$CH_2CH_2CN$; or —$CH_2CH_2C(O)XR_6$, where X is —O—, —S—, or —$NR_6$—, $R_6$ is hydrogen, or a hydrocarbyl group or —$(CH_2CHR_7$—O—$)_y$H where $R_7$ is hydrogen or a hydrocarbyl group and y=1 to 20; and $R_4$, and $R_5$ are independently hydrogen, hydrocarbyl groups or taken together form a ring, and (d) an overbased detergent in an amount that delivers at least 2 TBN to the lubricating composition.

9. The method of claim 2 wherein (c), the anthranilate ester, is a C10 to C16 ester of anthranilic acid.

* * * * *